United States Patent [19]

Olsen

[11] 4,121,879

[45] Oct. 24, 1978

[54] CONNECTOR ARRANGEMENT FOR CONDUCTOR RAILS

[75] Inventor: Kolbjorn Olsen, Harstad, Norway

[73] Assignee: Bjorn Kokvik, Oslo, Norway

[21] Appl. No.: 798,143

[22] Filed: May 18, 1977

[51] Int. Cl.[2] ..... H01R 3/06

[52] U.S. Cl. ..... 339/14 R; 339/21 R; 339/64 R

[58] Field of Search ..... 339/14 R, 14 L, 21 R, 339/21 S, 64 R, 64 M

[56] References Cited

U.S. PATENT DOCUMENTS

| | | | |
|---|---|---|---|
| 3,559,146 | 1/1971 | Valtonen | 339/21 S X |
| 3,918,224 | 11/1975 | Sundequist | 339/21 S X |

*Primary Examiner*—Roy Lake
*Assistant Examiner*—DeWalden W. Jones
*Attorney, Agent, or Firm*—Burns, Doane, Swecker & Mathis

[57] ABSTRACT

A connector for coupling electrical equipment to a conductor rail has its contacts positioned on flexible spring members which are elastically movable in both the horizontal and vertical directions, thus permitting the connector to accomodate itself to different embodiments of conductor rails. The connector can also have locking members positioned at different levels to enable the connector to be firmly fastened to conductor rails having variously-positioned attachment flanges. For grounded circuits, the connector can be provided with a twisted leaf spring as a ground connection.

4 Claims, 2 Drawing Figures

CONNECTOR ARRANGEMENT FOR CONDUCTOR RAILS

Figure 1:
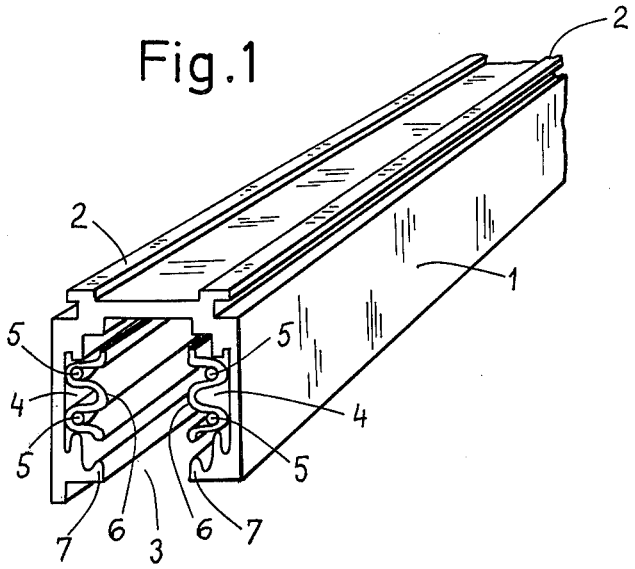

The present invention relates to a connector arrangement for coupling electrical equipment to conductor rails. "Conductor rails" in this instance means rails having an essentially U-shaped cross section, which may be located in rooms of any type, for example, in shops, factories, assembly halls and perhaps also in houses. The legs of the U-shaped cross section contain electrical conductors which are insulated from the supporting body of the rail, and even though a portion of each conductor is accessible for connection, the danger of touching a non-insulated wire is very small, because the insulating material which surrounds the conductors is formed in such a way that it is very difficult and perhaps impossible to come in through the open end of the U and reach the non-insulated conductors with any equipment other than that which is designated for that purpose. Conductor rails of this type may perhaps be mounted along the entire length of a room, and are to be found in a number of different embodiments which may differ somewhat from one another, but the basic coupling principle is essentially the same. In order to connect electrical equipment, such as lamps and machinery, to the rail at the location where the equipment is needed, connectors which can be attached at any place on the rail are used; these connectors have movable contacts which, when the connector is locked into place on the rail, move out and come into contact with the non-insulated conductors inside the conductor rail. The connector is locked into place on the conductor rail by means of movable lugs which cooperate with flanges on the conductor rail. On the side of the conductor which faces toward the bottom of the rail's U-shape, the connector may be provided with grounded contacts if the rail is adapted for this.

The situation discussed above, that many different embodiments of conductor rails of this general type exist, means that a connector which is designated to be used with one conductor rail can not be used on another rail, for example, because the noninsulated electrical conductors are positioned at different levels in different types of rails. Or, a problem can arise in trying to use a connector with ground contacts adapted for the bottom of its associated conductor rail in other rails which may have grounds in the sides of the rail. The attachment flanges by which the connector is mechanically fastened to the rail can also be different on different conductor rails; futhermore, a common disadvantage with known connectors is that the mechanism which locks the connector in place on the rail can be operated even though the connector is not properly in position, and it is then possible that the mechanism may become damaged.

The object of the present invention is to overcome the above disadvantages, and to provide a connector arrangement which can be utilized on different conductor rails with the assurance of proper electrical coupling and secure mechanical attachment with no risk of damage.

One of the features by which this purpose is achieved according to the invention is that the contacts which are to move into contact against the non-insulated conductors when the connector has been locked onto the rail, are made to be elastically movable in both the horizontal and vertical directions, so that when they are moved out for connection with the conductors, their elasticity will enable then to find their way in through slots in the insulating material, coming to rest against and in electrical contact with the conductors. In this way, it is possible to compensate for even rather significant differences in the positioning of the electrical conductors from one rail to another, because the contacts themselves, owing to their elasticity, manage to find their way to correct position.

The invention facilitates the mechanical attachment of the connector to conductor rails having different attachment flanges by the provision on the connector of two or more locking lugs, which can be spring-loaded and which can adapt themselves to the thickness or height of the flange in question.

Owing to the differences among different rails with respect to the location of their ground connections, and because some rails may not have grounds, the ground contacts provided according to the invention are springs, their spring movement being relative to the center plane of the connector.

Therefore, if connectors having a ground contact are used with conductor rails which do not have a ground connection in the bottom, the ground contact, being compressed when the connector is put into position, will move somewhat transverse to the direction of insertion and will find its way to the deepest point in the bottom of the U-shaped rail, for example, into a longitudinal groove in the rail.

To safeguard the locking mechanism against damage, the connector has a release mechanism which disengages the control members if the connector is not correctly positioned on the conductor rail.

Figure 2:
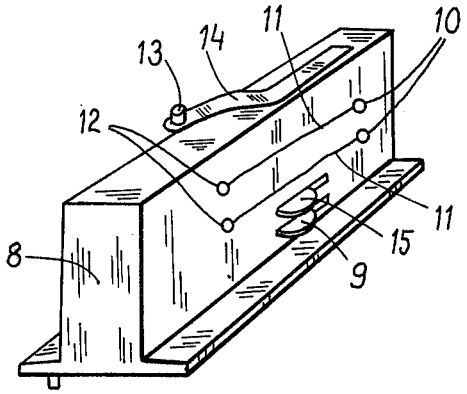

The invention is characterized by the features disclosed in the claims, and will be discussed in more detail in the following with reference to the figures, where FIG. 1 shows a portion of one embodiment of a conductor rail, and FIG. 2 is a greatly simplified drawing of a connector made in accordance with the invention.

The conductor rail in FIG. 1 is made of extruded aluminum 1, and is provided with flanges 2 on the outside for mounting the rail along a ceiling or wall. The rail of FIG. 1 is made to be mounted on a ceiling, and the rail is open at the bottom, as indicated by reference number 3. The rail is essentially U-shaped in cross section, and contains grooves 4 in its side walls in which electrical conductors 5 are retained, surrounded by insulation material 6. The insulation material is purposely shaped in such a way that it is practically impossible to get at the conductors 5 with thin objects inserted through the opening 3. Near the mouth of the opening 3, the rail has flanges 7 for attachment of the connector.

The conductor rail does not constitute a part of the present invention, and it can have many different embodiments, but the principle for most of them is the same.

The simplified connector shown on FIG. 2 is made according to the invention, and includes an insulating portion 8 of suitable dimensions to permit its insertion through the opening 3 in the rail of FIG. 1. By means of a control member (not shown) the locking lugs 9 on both sides of the connector can be rotated out to cooperate with the flange 7 on the conductor rail 1. The connector 8 is thus securely attached to the rail and can support a lamp or provide connection for a cable or some piece of electrical equipment. The same control member, or another control member, simultaneously moves the contacts 10 away from the connector 8 to bring them up against and/or into electrical contact with the conductors 5 in the conductor rail 1. In accordance with the invention, the contacts 10 are positioned on the ends of rather long, elastic members 11 made of spring wire or a similar material, which makes it possible for the contacts 10 to move both horizontally and vertically and, as explained previously, enables them to find their way to the conductors 5, 5 even if the rail and connector are not specifically adapted to fit precisely together.

When the connector 8 is to be released from the conductor rail, the contacts 10 can be moved in toward the connector, for example, by drawing the elastic members 11 in through openings 12 in the connector 8. The connector also has a ground contact 13 at the end of a spring 14 which is slightly twisted so that when the contact 13 is pushed sufficiently far in toward the connector 8, it moves somewhat transverse of the central plane of the connector.

In addition to the locking lugs 9, there is also a higher lug 15 which makes it possible to attach the connector 8 when the attaching flange 7 on the rail is positioned higher than the one shown on FIG. 1. The lower lug 9 will then not come into operation.

The examples shown here serve only to illustrate the invention and do not restrict the scope of protection given by this patent, in that one can easily imagine other embodiments of, for example, spring-like contacts which find their way in toward the non-insulated conductors when the spring force on the contacts forces the contacts toward the conductors.

Having described my invention, I claim:

1. In a connector adapted to be locked into place at any desired location along a conductor rail having fastening flanges and which supplies current for electrical equipment, wherein said connector is comprised of an insulated member and contacts operable to be brought into contact with non-insulated conductors in the rail, the improvement comprising:

flexible spring means mounting said contacts for movement in both horizontal and vertical directions whereby said contacts may be brought into contact with differently positioned, non-insulated conductors of differently constructed rails.

2. The improvement according to claim 1 wherein: said connector is provided with a plurality of locking lugs at different elevations, whereby said connector is attachable to rails having fastening flanges at different elevations.

3. The improvement according to claim 1 wherein: said connector includes at least one twisted leaf spring ground contact operable to move transversely of the connector when pressed toward said connector.

4. The improvement according to claim 1, wherein said spring means on which the contacts are positioned comprises two or more twisted, springy, current-conducting wires.

* * * * *